US007889140B2

(12) United States Patent
Wong et al.

(10) Patent No.: US 7,889,140 B2
(45) Date of Patent: Feb. 15, 2011

(54) ULTRA-WIDE BAND ANTENNA AND PLUG-AND-PLAY DEVICE USING THE SAME

(75) Inventors: Kin-Lu Wong, Kaohsiung (TW); Yu-Chan Yang, Taipei (TW); Wei-Yu Li, Yilan (TW); Saou-Wen Su, Taipei (TW); Jui-Hung Chou, Taichung (TW)

(73) Assignees: Lite-On Technology Corporation, Taipei (TW); National Sun Yat-Sen University, Kaoshsiung (TW)

( * ) Notice: Subject to any disclaimer, the term of this patent is extended or adjusted under 35 U.S.C. 154(b) by 223 days.

(21) Appl. No.: 11/878,963

(22) Filed: Jul. 30, 2007

(65) Prior Publication Data

US 2008/0238783 A1 Oct. 2, 2008

(30) Foreign Application Priority Data

Mar. 27, 2007 (TW) ..... 96110648 A

(51) Int. Cl.
*H01Q 1/24* (2006.01)

(52) U.S. Cl. ..... 343/702; 343/700 MS

(58) Field of Classification Search ..... 343/700 MS, 343/767, 702

See application file for complete search history.

(56) References Cited

U.S. PATENT DOCUMENTS 6,661,380 B1 * 12/2003 Bancroft et al. ..... 343/700 MS
6,950,068 B2 * 9/2005 Bordi et al. ..... 343/702
7,126,544 B2 * 10/2006 Liu et al. ..... 343/700 MS
2004/0140938 A1 * 7/2004 Kadambi et al. ..... 343/702

OTHER PUBLICATIONS

M. J. Ammann, "Control of the Impedence Bandwidth of Wideband Planar Monopole Antennas Uisng A Beveling Technique," Mar. 8, 2001, Microwave and Optical Technology Letters, vol. 30, No. 4, pp. 229-231.*

Yong-Xin Guo, Michael Yan Wah Chia, Zhi Ning Chen, and Kwai-Man Luk, Apr. 14, 2003, Wideband L-Probe Fed Circular Patch Antenna For Conical-Patten Radiation, IEEE Transactions on Antennas and Propagation, vol. 52, No. 4, pp. 1115-1116.*

* cited by examiner

*Primary Examiner*—Jacob Y Choi
*Assistant Examiner*—Kyana R Robinson
(74) *Attorney, Agent, or Firm*—Bacon & Thomas, PLLC

(57) ABSTRACT

An ultra-wide band (UWB) antenna and a plug-and-play (PnP) device using the same are provided. A dielectric substrate of the PnP device has a ground plane. The UWB antenna includes a radiating metal plate and a feeding portion. The radiating metal plate is in a non-ground region of the dielectric substrate and has at least a slit cut. An opening of the slit cut is at the edge of the radiating metal plate facing the ground plane. The feeding portion is also at the edge of the radiating metal plate facing the ground plate for feeding a signal to the antenna.

8 Claims, 9 Drawing Sheets

2

8

9

ULTRA-WIDE BAND ANTENNA AND PLUG-AND-PLAY DEVICE USING THE SAME

This application claims the benefit of Taiwan application Serial No. 96110648, filed Mar. 27, 2007, the subject matter of which is incorporated herein by reference.

BACKGROUND OF THE INVENTION

1. Field of the Invention

The invention relates in general to an antenna, and more particularly to an antenna for a plug-and-play device.

2. Description of the Related Art

As wireless communication technology advances, it is a trend that wireless signal transmission will replace wired signal transmission in the near future.

Since the Federal Communications Commission declared the standard of the ultra-wide band (UWB) technology in 2002, researches and inventions relative to the UWB technology have been emerged in great numbers. Although the Federal Communications Commission approved the commercial use of UWB transmissions in the range from 3.1 GHz to 10.6 GHz, now the most widely used band for commercial use is only from 3.1 GHz to 6.0 GHz, which is the lower band of the UWB.

When the band is wider, the data transmission speed is faster. The UWB technology can achieve 100~500 Mb/s transmission speed, which is much greater than the conventional speed. Also, the UWB technology provides larger transmission capacity. The image transmission can hence be sent wirelessly through the UWB technology easily. The goal to provide the wireless home theater can be achieved accordingly.

Furthermore, the wireless signal transmission between computer peripherals, such as a keyboard, a mouse, a screen, a printer or a fax machine, can be achieved through the UWB technology. In the future, the personal computer only needs to be connected to a universal serial bus (USB) plug-and-play device that has an integrated UWB signal-receiving module for transmitting signals between the computer and the peripherals. Therefore, it is very important to develop a compact UWB antenna for the USB plug-and-play device.

A planar monopole antenna disclosed in Taiwan Patent No. I248,231 and an omni-directional broadband monopole antenna disclosed in Taiwan Patent No. I239,122, the length of the antenna is equal to about 0.18 times the wavelength of the lowest operating frequency. When the trend of the plug-and-play device is toward compact-size devices, the length of the antenna limits the size of the device.

SUMMARY OF THE INVENTION

The invention is directed to an ultra-wide band (UWB) antenna and a plug-and-play device using the same. The length of the UWB antenna is only about 10 mm, which is 0.1 times the wavelength of the lowest operating frequency 3.1 GHz. The present invention generates an operating bandwidth covering the lower band (3.1~6.0 GHz) of the whole UWB band. Also, the antenna of the present invention has the advantages of simple structure, easy manufacture and low cost.

According to the present invention, an ultra-wide band (UWB) antenna for a plug-and-play device is provided. A dielectric substrate of the plug-and-play device has a ground plane. The UWB antenna includes a radiating metal plate and a feeding portion. The radiating metal plate is in a non-ground region on the dielectric substrate and has at least a slit cut. An opening of the slit cut is at the edge of the radiating metal plate facing the ground plane. The feeding portion is also at the edge of the radiating metal plate facing the ground plane for feeding a signal to the antenna.

According to the present invention, a plug-and-play device including a main body and an ultra-wide band (UWB) antenna is provided. The main body includes a dielectric substrate having a ground plane. The UWB antenna includes a radiating metal plate and a feeding portion. The radiating metal plate is in a non-ground region on the dielectric substrate and has at least a slit cut. An opening of the slit cut is at the edge of the radiating metal plate facing the ground plane. The feeding portion is also at the edge of the radiating metal plate facing the ground plane for feeding a signal to the antenna.

The invention will become apparent from the following detailed description of the preferred but non-limiting embodiments. The following description is made with reference to the accompanying drawings.

DETAILED DESCRIPTION OF THE INVENTION

In an ultra-wide band (UWB) antenna of the present invention, a slit cut is formed on a metal plate for increasing the resonance current path of the antenna so as to reduce the size of the antenna. An opening of the silt cut is at the edge of the radiating metal plate facing the ground plane. Because the current distribution is stronger there, the slit cut formed there has significant effects of frequency decreasing. Also, the antenna of the present embodiment has wide impedance bandwidth and good radiation efficiency, which satisfy the practical demand of the UWB system. Several embodiments are provided as follow to illustrate the present invention.

First Embodiment

Figure 1:
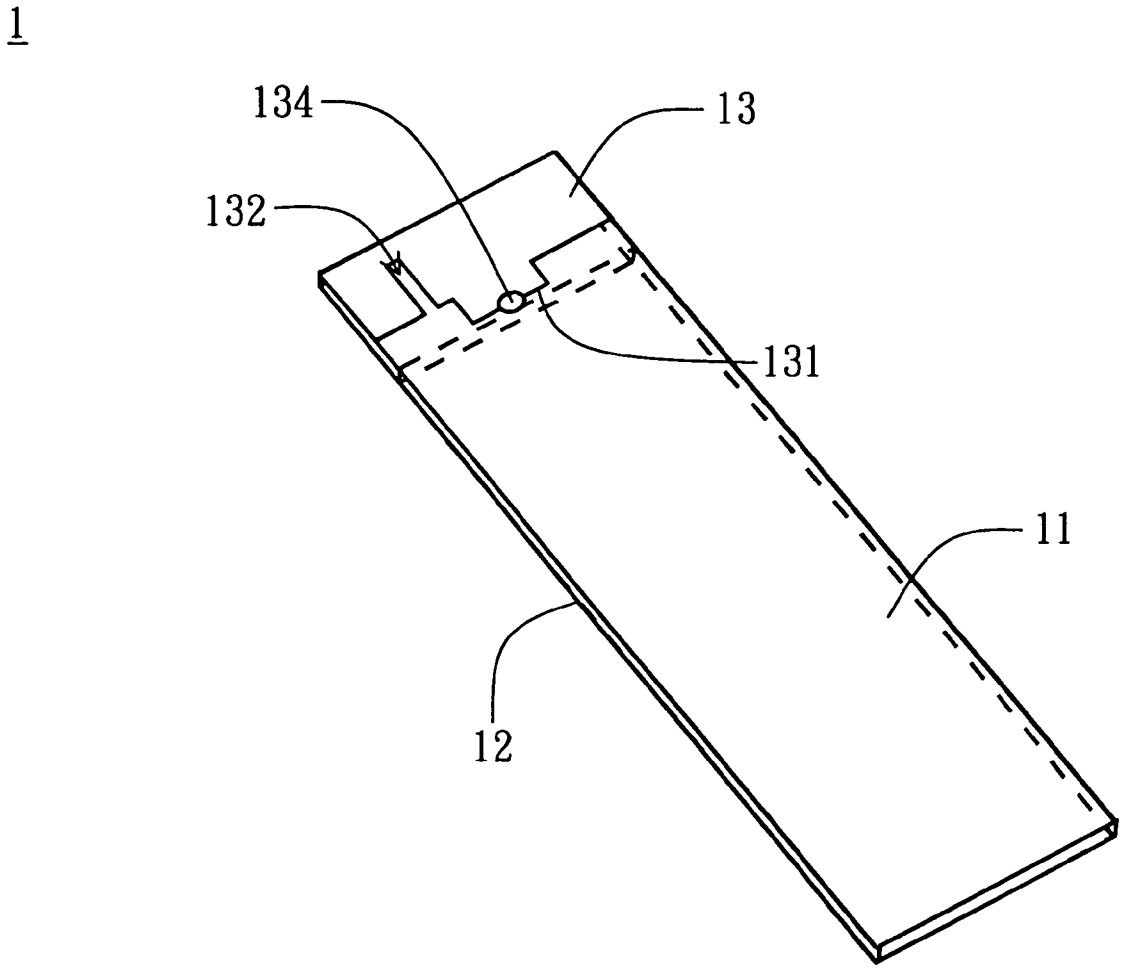
FIG. 1 illustrates an ultra-wide band (UWB) antenna according to a first embodiment of the present invention.

FIG. 1 illustrates an UWB antenna according to a first embodiment of the present invention. Please referring to FIG. 1, the UWB antenna 1 is disposed on a dielectric substrate 11, such as a system circuit board of a plug-and-play device. Aground plane 12 is on the dielectric substrate 11. A radiating metal plate 13 of the antenna 1 is in a non-ground region of the dielectric substrate 11. The radiating metal plate 13 is substantially rectangular and has at least one slit cut 132. An opening of the slit cut 132 is at the edge 131 of the radiating metal plate 13 facing the ground plane 12. A feeding portion 134 of the antenna 1 is also at the edge 131 of the radiating metal plate 13 facing the ground plane 12, for feeding a signal to the antenna 1. For example, the radiating metal plate 13 is formed on the dielectric substrate 11 by printing or etching.

Figure 2:
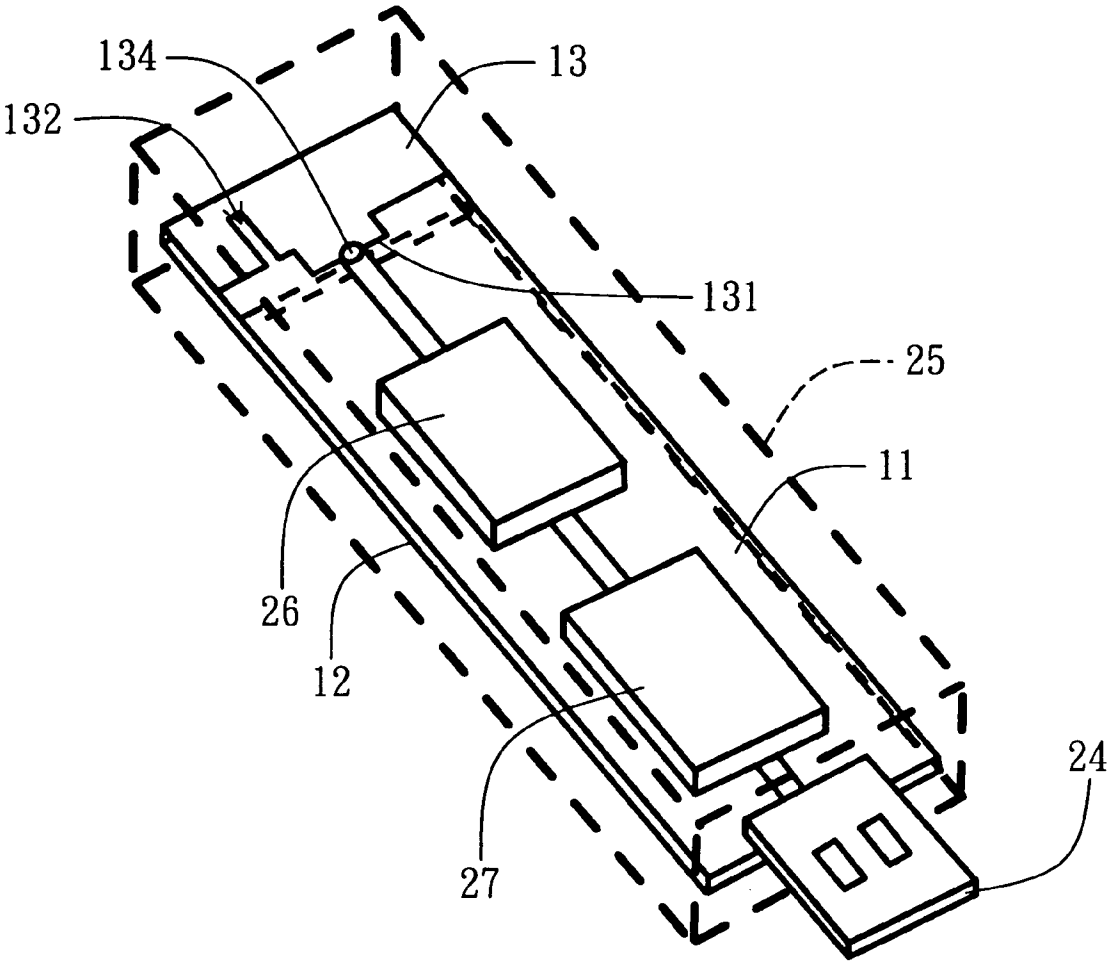
FIG. 2 illustrates a plug-and-play device applying the UWB antenna.

Please referring to FIG. 2, the plug-and-play device applying the UWB antenna is illustrated in FIG. 2. As shown in FIG. 2, the plug-and-play device 2 includes a connector 24 and a main body 25. The connector 24 is for connecting with a mainframe. The antenna inside the main body 25 is shown as FIG. 1 (the same reference numbers are used for the components in FIG. 2 the same as those in FIG. 1). The antenna 1 is on the dielectric substrate 11 inside the main body 25. A radio frequency circuit 26 and a digital signal processing circuit 27 are disposed on the ground plane 12 of the dielectric substrate 11.

What is worth mentioning is that a slit cut 132 is formed on the radiating metal plate 13 of the present embodiment for increasing the resonance current path of the antenna. As a result, the size of the antenna is reduced. The opening of the slit cut 132 is at the edge 131 of the radiating metal plate 13 facing the ground plane 12. The current distribution is stronger here. Therefore, the slit cut 132 formed here has significant effects of frequency reduction.

Figure 3:
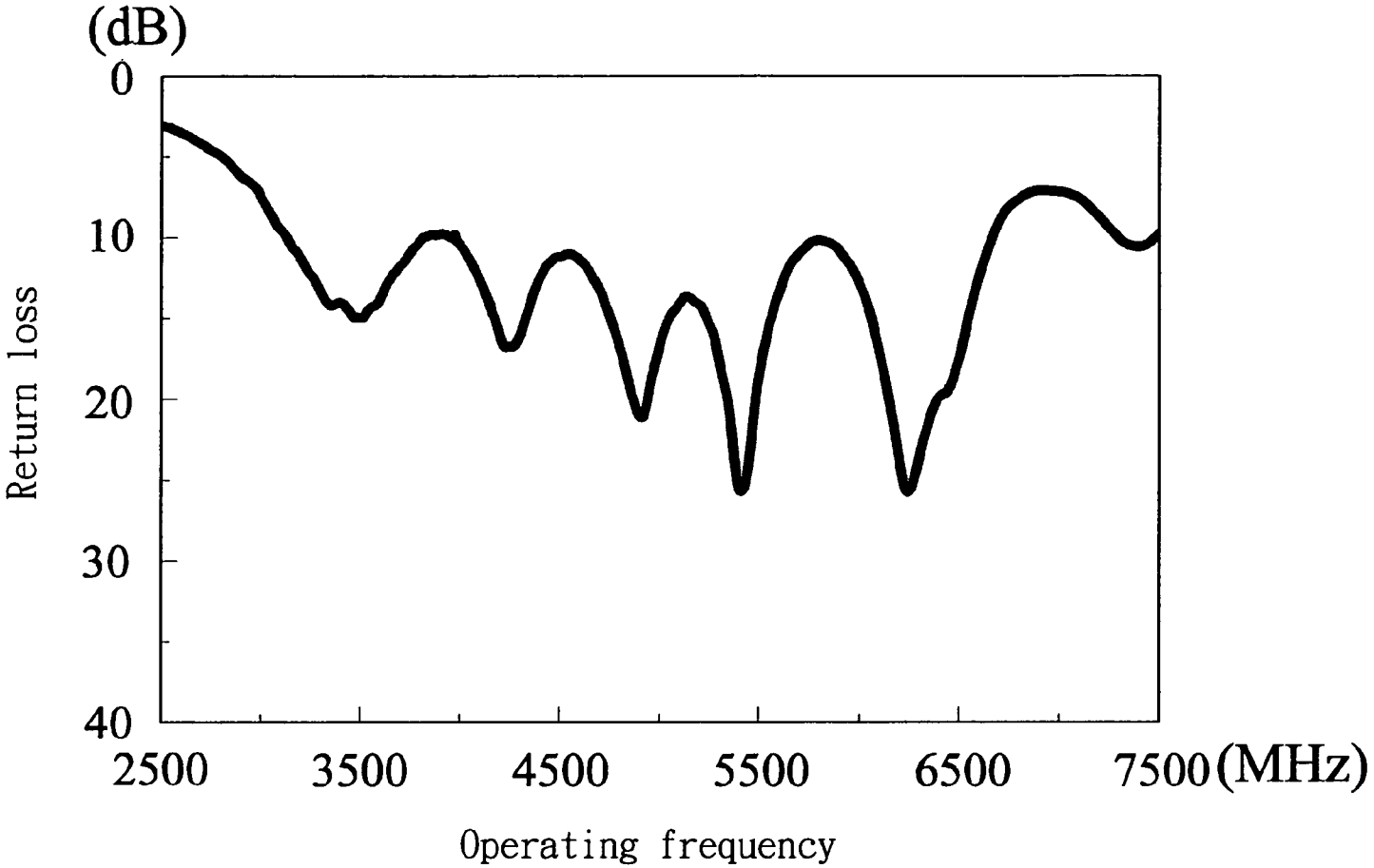
FIG. 3 shows a test result of the return loss of the UWB antenna in FIG. 1.

Please referring to FIG. 3, a test result of the return loss of the UWB antenna in FIG. 1 is illustrated in FIG. 3. The design of the radiating metal plate in the test is described as follow. The radiating metal plate 13 is substantially rectangular. The length of the radiating metal plate 13 is 10 mm, and the width of the radiating metal plate 13 is 20 mm. The length of the slit cut 132 of the radiating metal plate 13 is 5 mm, and the width is 1 mm. The thickness of the radiating metal plate 13 is 0.8 mm. The longitudinal axis in FIG. 3 represents the return loss, and the transverse axis represents the operating frequency. As shown in FIG. 3, the return loss of the antenna of the present embodiment is greater than 10 dB over the band that ranges from 3.1 GHz to 6 GHz. Generally speaking, the return loss of the antenna satisfies the practical demand of the UWB system.

Figure 4:
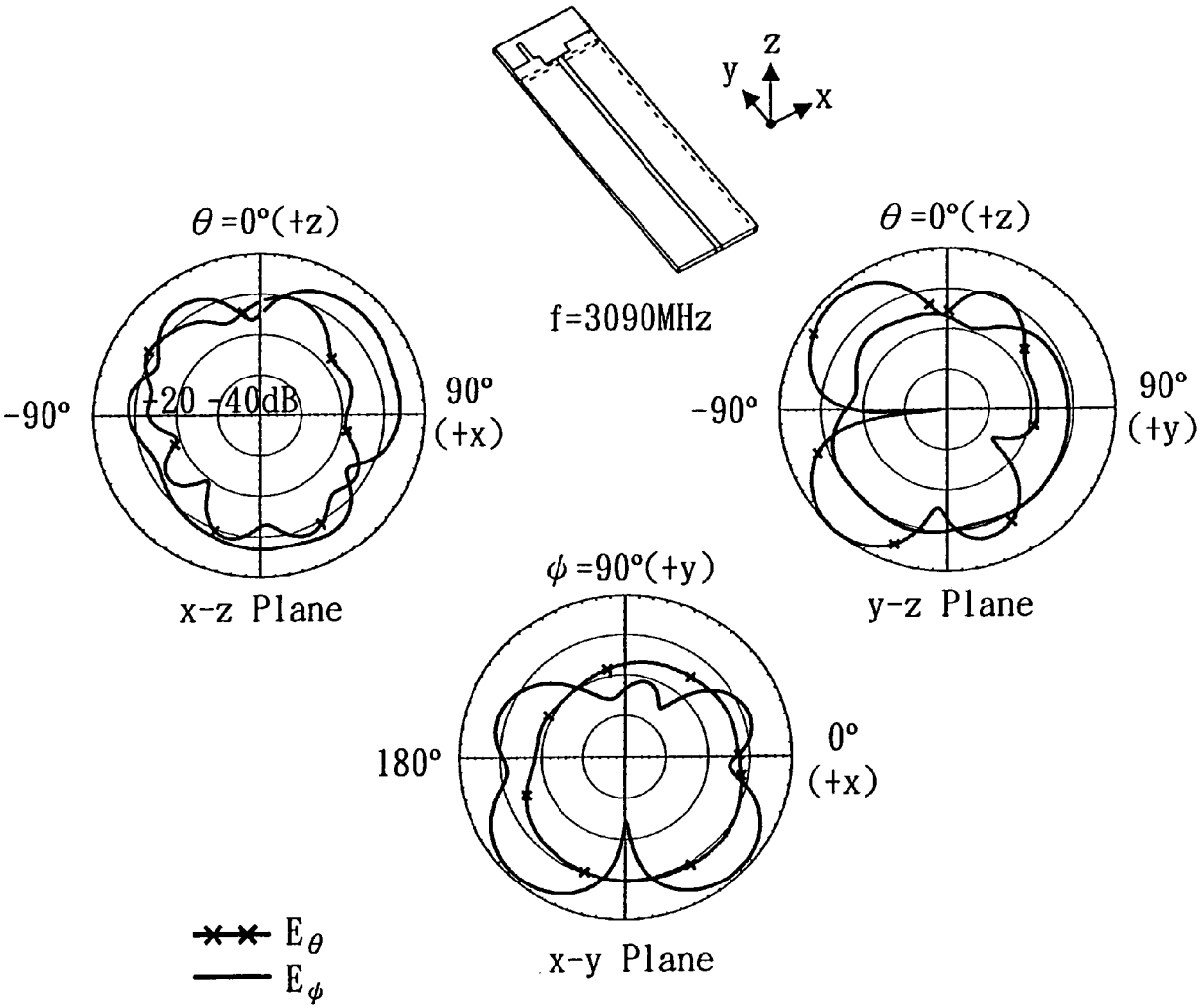
FIG. 4 shows radiation pattern of the UWB antenna in FIG. 1 at 3090 MHz.
Figure 5:
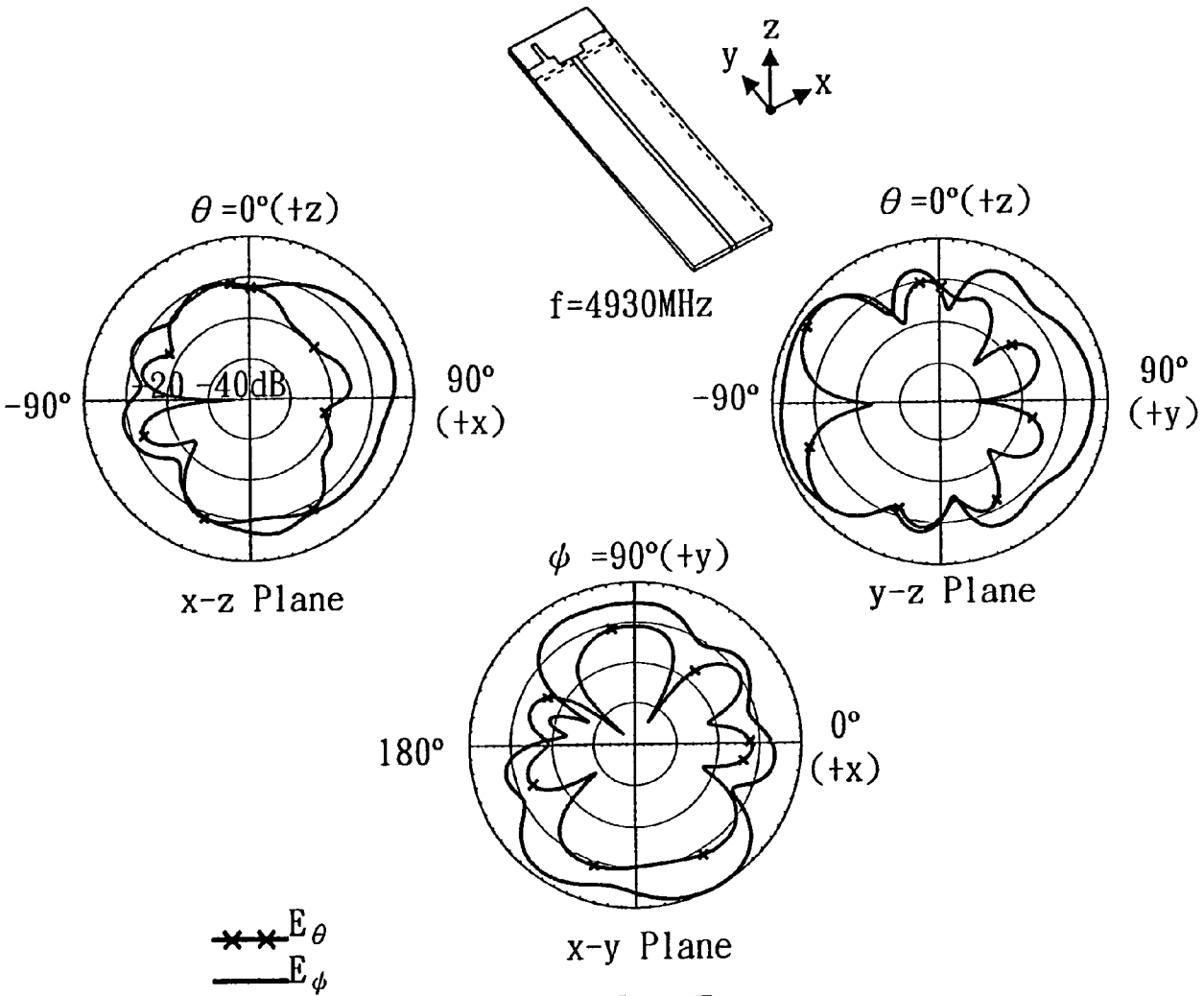
FIG. 5 shows radiation pattern of the UWB antenna in FIG. 1 at 4930 MHz.

FIG. 4 and FIG. 5 show radiation patterns of the UWB antenna in FIG. 1 at 3090 MHz and 4930 MHz respectively. As learned from FIG. 4 and FIG. 5, the difference between the radiation patterns of $E_\theta$ and $E_\phi$ in the horizontal plane (x-y plane) is small. Therefore, the multi-path fading of the signals can be reduced.

Figure 6:
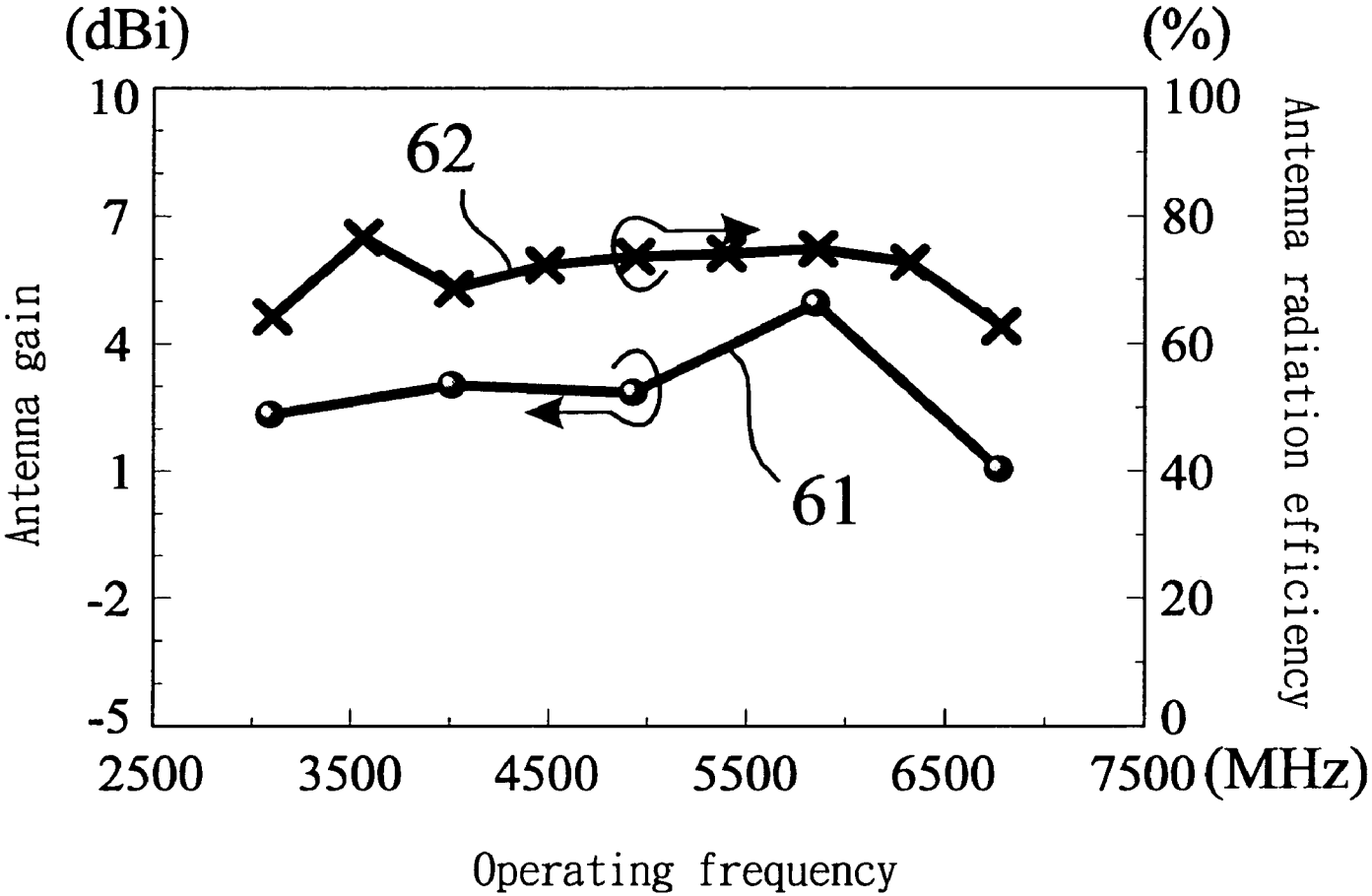
FIG. 6 shows antenna gain and radiation efficiency of the UWB antenna in FIG. 1 over the operating band.

FIG. 6 shows antenna gain and radiation efficiency of the UWB antenna in FIG. 1 over the operating band. Please referring to FIG. 6, the transverse axis on the right hand side represents the radiation efficiency of the antenna. The transverse axis on the left hand side represents the antenna gain. The longitudinal axis represents the operating frequency. The curve of the antenna gain is the curve 61. The curve of the radiation efficiency of the antenna is the curve 62. As shown in FIG. 6, when the band is within the range between 3.1 GHz and 6.0 GHz, the radiation efficiency of the antenna is greater than 60%. Also, the antenna gain is greater than 1 dBi. Therefore, the antenna has good radiation performance.

The planar monopole antenna disclosed in Taiwan Patent No. I248,231 and the omni-directional broadband monopole antenna disclosed in Taiwan Patent No. I239,122, the length of the antenna is about 0.18 times the wavelength of the lowest operating frequency. The length of the antenna of the present embodiment is only 10 mm, which is substantially 0.1 times the wavelength of the lowest operating frequency 3.1 GHz. Therefore, when the antenna 1 of the present embodiment is applied to the plug-and-play device or other electronic devices, the occupied space is relatively smaller. As a result, the size of the device embedded with the antenna 1 can be reduced. Meanwhile, the antenna still has wide impedance bandwidth and good radiation efficiency for satisfying the practical demand of the UWB system.

Second Embodiment

Figure 7:
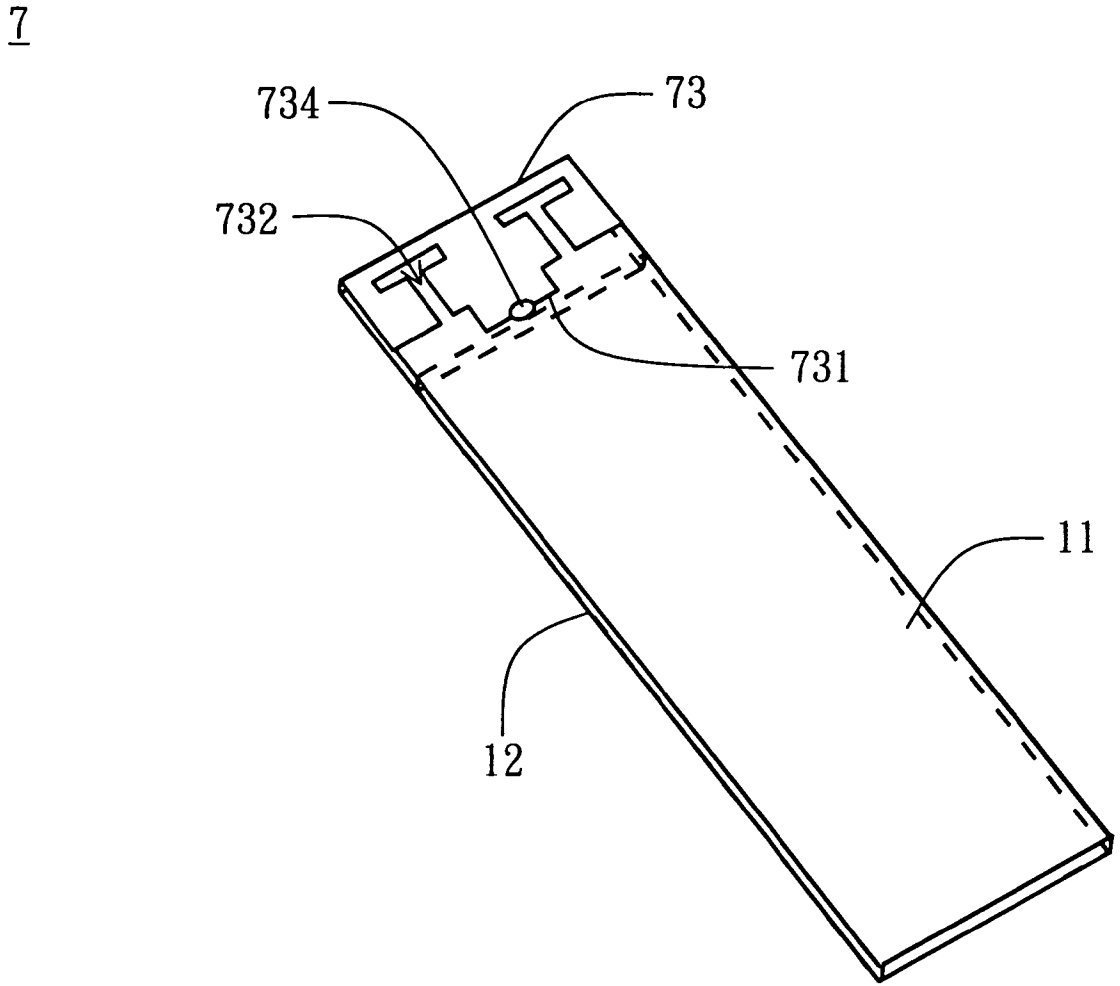
FIG. 7 illustrates the UWB antenna according to a second embodiment of the present invention.

Please referring to FIG. 7, the UWB antenna according to a second embodiment of the present invention is illustrated in FIG. 7. The UWB antenna of the second embodiment and that of the first embodiment are different in the structural design of the antenna. The same components use the same reference numbers and are not described repeatedly. As shown in FIG. 7, the radiating metal plate 73 has two slit cuts 732. Preferably, the slit cuts 732 are in the non-ground region 12 and symmetric to the feeding portion 734. The slit cuts 732 are T-shaped. Although the shape of the slit cut of the present embodiment is different from that of the first embodiment, the slit cuts 732 still can increase the resonance current path of the antenna. Therefore, the size of the antenna 7 of the present embodiment is reduced.

Similarly, the opening of the slit cut 732 is at the edge 731 of the radiating metal plate 73 facing the ground plane 12. Because the current distribution is stronger here, the slit cut 732 formed here has significant effect of frequency decreasing. Except the difference in the shape of the slit cuts 732 on the radiating metal plate 73, other structures of the present embodiment are the same as those of the first embodiment. Therefore, the antenna of the second embodiment satisfies the demand of the impedance bandwidth and the radiation efficiency of the UWB antenna.

Third Embodiment

Figure 8:
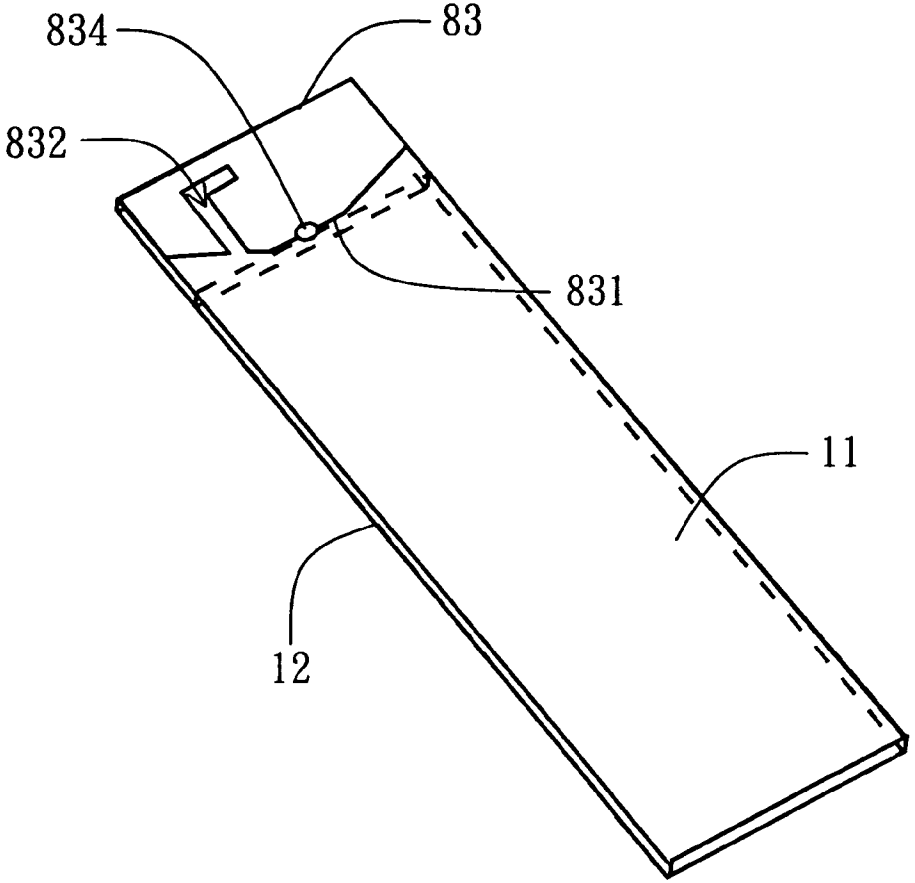
FIG. 8 illustrates the UWB antenna according to a third embodiment of the present invention.

Please referring to FIG. 8, the UWB antenna according to a third embodiment of the present invention is illustrated in FIG. 8. The UWB antenna of the third embodiment and that of the first embodiment are different in the structural design of the antenna. The same components use the same reference numbers and are not described repeatedly. As shown in FIG. 8, the slit cut 832 of the radiating metal plate 83 of the antenna 8 is inverted L-shaped. Also, a corner of the radiating metal plate 83 is cut. The opening of the slit cut 832 is at this corner and faces the ground plane 12. The feeding portion 834 of the radiating metal plate 83 is also at the edge 831. The design of the inverted L-shaped slit cut and the cut corner increase the resonance current path of the antenna. As a result, the size of the antenna of the present embodiment is reduced. Because the current distribution at the edge 831 of the ground plane 12 is stronger, the slit cut 832 formed here has significant effects of frequency decreasing. Except the difference in the shapes of the radiating metal plate 83 and the slit cut 832, the other structures of the antenna 8 of the third embodiment are the same as those of the first embodiment. Therefore, the antenna of the third embodiment satisfies the demand of the impedance bandwidth and the radiation efficiency of the UWB antenna.

Fourth Embodiment

Figure 9:
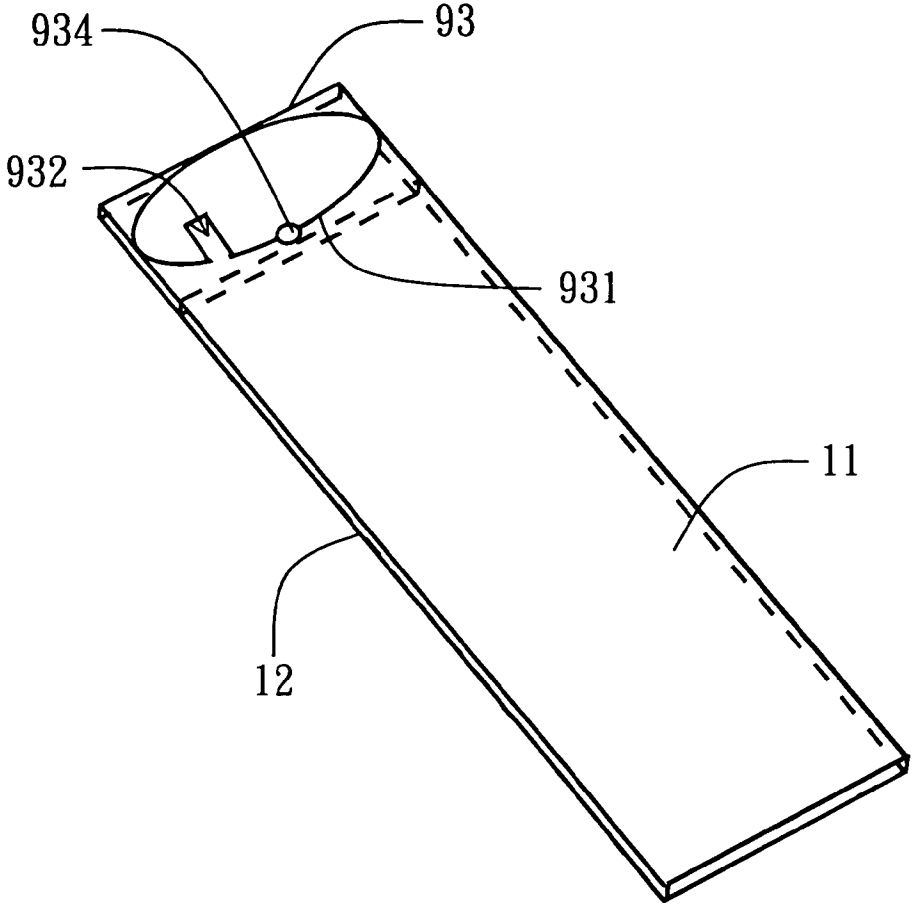
FIG. 9 illustrates the UWB antenna according to a fourth embodiment of the present invention.

Please referring to FIG. 9, the UWB antenna according to a fourth embodiment of the present invention is illustrated in FIG. 9. The UWB antenna of the fourth embodiment and that of the first embodiment are different in the structural design of the antenna. Other components use the same reference numbers and are not described repeatedly. As shown in FIG. 9, the radiating metal plate 93 of the antenna 9 can be circular or elliptic. Although the radiating metal plate 93 is different from the radiating metal plate 13 of the first embodiment, the antenna of the present embodiment can still satisfy the demand of the impedance bandwidth and the radiation efficiency of the UWB antenna. The feeding portion 934 of the radiating metal plate 93 is at the edge 931. The slit cut 932 on the radiating metal plate 93 increases the resonant current path of the antenna. Therefore, the size of the antenna 9 of the present embodiment is reduced. Moreover, the opening of the slit cut 932 is at the edge 931 of the radiating metal plate 93 facing the ground plane 12. The current distribution is stronger here. Therefore, the slit cut 932 formed here has significant effect of frequency reduction. Except the difference between the shape of the radiating metal plate 93 of the present embodiment and that of the first embodiment, other structures of the antenna 9 of the fourth embodiment are the same as those of the first embodiment.

In the UWB antennas and the plug-and-play devices disclosed in the above embodiments of the present invention, the slit cut is formed in a proper place on the radiating metal plate for increasing the resonant current path of the antenna. As a result, the size of the antenna of the present invention is reduced. The opening of the slit cut is at the edge of the radiating metal plate and faces the ground plane, where the current distribution is stronger. Therefore, the slit cut formed here has significant effect of frequency decreasing and the band from 3.1 GHz to 6.0 GHz is encompassed. Also, the radiation pattern and the radiation efficiency satisfy the practical demand of the UWB system. Furthermore, the antenna of the present invention has advantages of simple structure, easy manufacture and low cost.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An ultra-wide band (UWB) antenna applied to a plug-and-play device, the plug-and-play device includes a dielectric substrate having a ground plane, the UWB antenna comprising:

a radiating metal plate disposed in a non-ground region of the dielectric substrate and having at least one slit cut formed by at least two cut segments, an opening of the slit cut being at an edge of the radiating metal plate facing the ground plane, wherein the slit cut extends from the edge of the radiating metal plate and into the radiating metal plate towards a short edge of the dielectric substrate and along a longitudinal edge of the dielectric substrate; and a feeding portion disposed on an apex of the radiating metal plate facing the ground plane for feeding a signal to the antenna;

wherein the radiating metal plate is disconnected from the ground plane; and the radiating metal plate has two slit cuts on two sides of the feeding portion.

2. The UWB antenna according to claim 1, wherein the dielectric substrate is a system circuit board.

3. The UWB antenna according to claim 1, wherein the radiating metal plate is formed on the dielectric substrate by printing or etching.

4. The UWB antenna according to claim 1, wherein the slit cut is T-shaped.

5. A plug-and-play device comprising:

a main body comprising a dielectric substrate, a ground plane being on the dielectric substrate; and an ultra-wide band antenna comprising:

a radiating metal plate disposed in a non-ground region of the dielectric substrate and having at least one slit cut formed by at least two cut segments, an opening of the slit cut being at an edge of the radiating metal plate facing the ground plane, wherein the slit cut extends from the edge of the radiating metal plate and into the radiating metal plate towards a short edge of the dielectric substrate and along a longitudinal edge of the dielectric substrate; and a feeding portion disposed on an apex of the radiating metal plate facing the ground plane for feeding a signal to the antenna;

wherein the radiating metal plate is disconnected from the ground plane; and the radiating metal plate has two slit cuts on two sides of the feeding portion.

6. The plug-and-play device according to claim 5, wherein the dielectric substrate is a system circuit board.

7. The plug-and-play device according to claim 5, wherein the radiating metal plate is formed on the dielectric substrate by printing or etching.

8. The plug-and-play device according to claim 5, wherein the slit cut is T-shaped.

* * * * *